US007200905B2

(12) United States Patent
Cunningham et al.

(10) Patent No.: US 7,200,905 B2
(45) Date of Patent: Apr. 10, 2007

(54) CASKET HAVING LIGHTED CORNERS

(75) Inventors: Gary R. Cunningham, Greensburg, IN (US); Donald Maple, Batesville, IN (US); Paul M. Schnepp, Columbus, IN (US)

(73) Assignee: Batesville Services, Inc., Batesville, IN (US)

( * ) Notice: Subject to any disclaimer, the term of this patent is extended or adjusted under 35 U.S.C. 154(b) by 92 days.

(21) Appl. No.: 10/769,413

(22) Filed: Jan. 30, 2004

(65) Prior Publication Data

US 2005/0166375 A1 Aug. 4, 2005

(51) Int. Cl.
*A61G 17/00* (2006.01)

(52) U.S. Cl. ..... 27/2; 27/10

(58) Field of Classification Search ..... 27/2, 27/19, 1, 10; 52/287.1; 362/154
See application file for complete search history.

(56) References Cited

U.S. PATENT DOCUMENTS

| | | | | |
|---|---|---|---|---|
| 1,102,626 | A | 7/1914 | Zeranski | |
| 1,436,757 | A * | 11/1922 | Fishman | 27/31 |
| 1,452,029 | A | 4/1923 | Deuel | |
| 1,457,650 | A * | 6/1923 | Brown | 24/334 |
| 1,471,023 | A | 10/1923 | Bien | |
| 1,672,317 | A * | 6/1928 | Hill | 248/214 |
| 1,871,611 | A | 8/1932 | Headland | |
| 1,891,963 | A | 12/1932 | Weber et al. | |
| 1,912,035 | A | 5/1933 | Grant | |
| 2,019,192 | A | 10/1935 | Minkel | |
| 2,052,382 | A * | 8/1936 | Coaltrin | 362/154 |
| 2,147,008 | A * | 2/1939 | Blumenthal | 362/291 |
| 2,179,409 | A | 11/1939 | Hulsart | |
| 3,791,594 | A | 2/1974 | Relly | |
| 5,426,573 | A | 6/1995 | Jenkins | |
| 5,533,241 | A | 7/1996 | McConnell | |

* cited by examiner

*Primary Examiner*—William L. Miller
(74) *Attorney, Agent, or Firm*—Wood, Herron & Evans, LLP

(57) ABSTRACT

The present invention is an ornamental light assembly for a casket. The casket has a pair of opposed side walls and a pair of opposed end walls. The light assembly comprises a back plate adapted to be mounted to at least one of the walls of the casket shell. A base member having a top and bottom wall and at least one side wall connecting the top and bottom wall is coupled to the back plate. The top wall of the base member includes a light source, such as a light bulb, and a translucent ornament overlying the light source such that the light emitted from the light source is transmitted through the translucent ornament. The base member can include at least one battery for powering the light source and an electrical switch for energizing the light source.

18 Claims, 3 Drawing Sheets

CASKET HAVING LIGHTED CORNERS

FIELD OF THE INVENTION

This invention relates generally to caskets, and more particularly to decorative light fixtures attached to the corners of a casket.

BACKGROUND OF THE INVENTION

There is a trend in the death care industry to make efforts towards "personalizing" the funeral products and the funeral or other memorial service purchased for the deceased to provide a more meaningful memorial experience for the family and friends of the deceased. The casket in which the deceased is displayed can be customized to fit the needs and preferences of the deceased and the family. For instance, a wide variety of materials, finishes, colors, and decorative ornamentation can be chosen to meet these needs. The purchaser of a casket can also customize the casket using a variety of stylized trim or corner pieces. These stylized corner pieces usually have standardized decorative elements as chosen by the manufacture. In addition, these corner pieces typically are not personalized.

Some casket designs incorporate decorative or ornamental corner pieces secured to the casket during fabrication thereof. In many, if not most, prior designs, these ornamental corner pieces are rigidly affixed to the casket shell. Consequently, if a customer purchasing the casket is not pleased with the particular pre-installed ornamental corner pieces, and wishes to customize the casket exterior to his or her taste, the funeral director must go through a lengthy and complicated process to first remove the original ornamental corner pieces and then reinstall the ornamental corner pieces chosen by the customer. This process typically requires manual manipulation and access to the interior or the casket which can require the removal of bedding, lining, and the like. Such a process is time consuming and can damage the otherwise new casket and is thus frowned upon and generally avoided by the funeral director.

To more effectively market caskets, the funeral director desires to offer a wide variety of ornamental corner pieces from which a customer can select according to the customer's taste. However, to offer such a wide selection, and to avoid the undesirable practice mentioned above, the funeral director would have to maintain a large inventory of many different casket material/finish and corner piece combinations, which is also undesirable. To minimize the required inventory of finished caskets, the funeral director could simply have one casket of each material/finish provided that the funeral director had some means providing for the quick and efficient changing of the ornamental corner pieces on each casket. As such, the customer could quickly view numerous corner pieces on a single casket, and the funeral director would need only stock a single casket of each material finish. Many prior casket designs, which rigidly affix the ornamental corner pieces, do not permit such quick and efficient changing of the ornamental corner pieces as discussed above.

A quick-change casket corner mechanism is disclosed in Acton et al. U.S. Pat. No. 6,591,466, assigned to the assignee of the present invention and incorporated by reference herein. Acton discloses an ornamental corner piece assembly having a back plate that attaches to the corner of a casket. The back plate includes a clip member having at least one keyhole groove. A decorative corner insert includes at least one attachment member that slidingly engages the keyhole groove in the clip member such that the corner insert removably couples to the back plate. In this way, a funeral director can quickly and conveniently change out the decorative corner pieces to provide a wide variety of casket designs personalized to the deceased.

Advances have therefore been made in the area of casket designs incorporating decorative or ornamental corner pieces as demonstrated with the product discussed above. However, there continues to be room for improvement in the area of personalization in the death care industry.

SUMMARY OF THE INVENTION

The present invention is an ornamental light assembly for a casket. The casket has a pair of opposed side walls and a pair of opposed end walls. The light assembly comprises a back plate adapted to be mounted to at least one of the walls of the casket shell. A base member having a top and bottom wall and at least one side wall connecting the top and bottom wall is coupled to the back plate. The top wall of the base member includes a light source and a translucent ornament overlying the light source such that the light emitted from the light source is transmitted through the translucent ornament to illuminate at least a portion of the casket shell. The ornament can take a wide variety of designs and be chosen so as to have a special meaning to the deceased or his/her family. In this way, the casket can be personalized to the deceased and provide a more meaningful burial service.

In one embodiment of the present invention the base member is generally triangularly shaped and couples to the back plate along at least a portion of one side wall of the base member. The light source comprises a light bulb inserted into the top wall of the base member. The light assembly can further include a power source for operating the light source, such as, for example, at least one battery carried in the base member. The light assembly can further include an electrical switch in the base member for energizing the light source.

In another aspect of the invention, a casket includes a shell having a pair of opposed side walls and a pair of end walls. At least one corner wall is disposed between adjacent side walls and end walls such that the corner wall is angled relative to them both. The casket further includes a light assembly removably mounted to the casket. The light assembly includes a back plate that is mounted to the corner wall. A base member is coupled to the back plate. A light source, such as a light bulb, is coupled to a top surface of the base member and further includes a translucent ornament overlying the light source so that the light emitted from the light source is transmitted through the translucent ornament. The light assembly can further include a power source for operating the light source, such as, for example, at least one battery carried in the base member. The base member can further include an electrical switch for energizing the light source.

In yet another aspect of the present invention, a casket comprises a casket shell including a pair of side walls and a pair of end walls; and, a light assembly mounted to at least one of the walls of the casket shell, the light assembly including a light source for illuminating at least a portion of the casket shell.

In still another aspect of the present invention, a casket comprises a casket shell having at least one corner; and, a light assembly mounted to the corner of the shell.

These and other features and advantages of the present invention will become more readily apparent during the following detailed description taken in conjunction with the drawings herein, in which:

BRIEF DESCRIPTION OF THE DRAWINGS OF THE INVENTION

DETAILED DESCRIPTION OF A PREFERRED EMBODIMENT OF THE INVENTION

Figure 1:
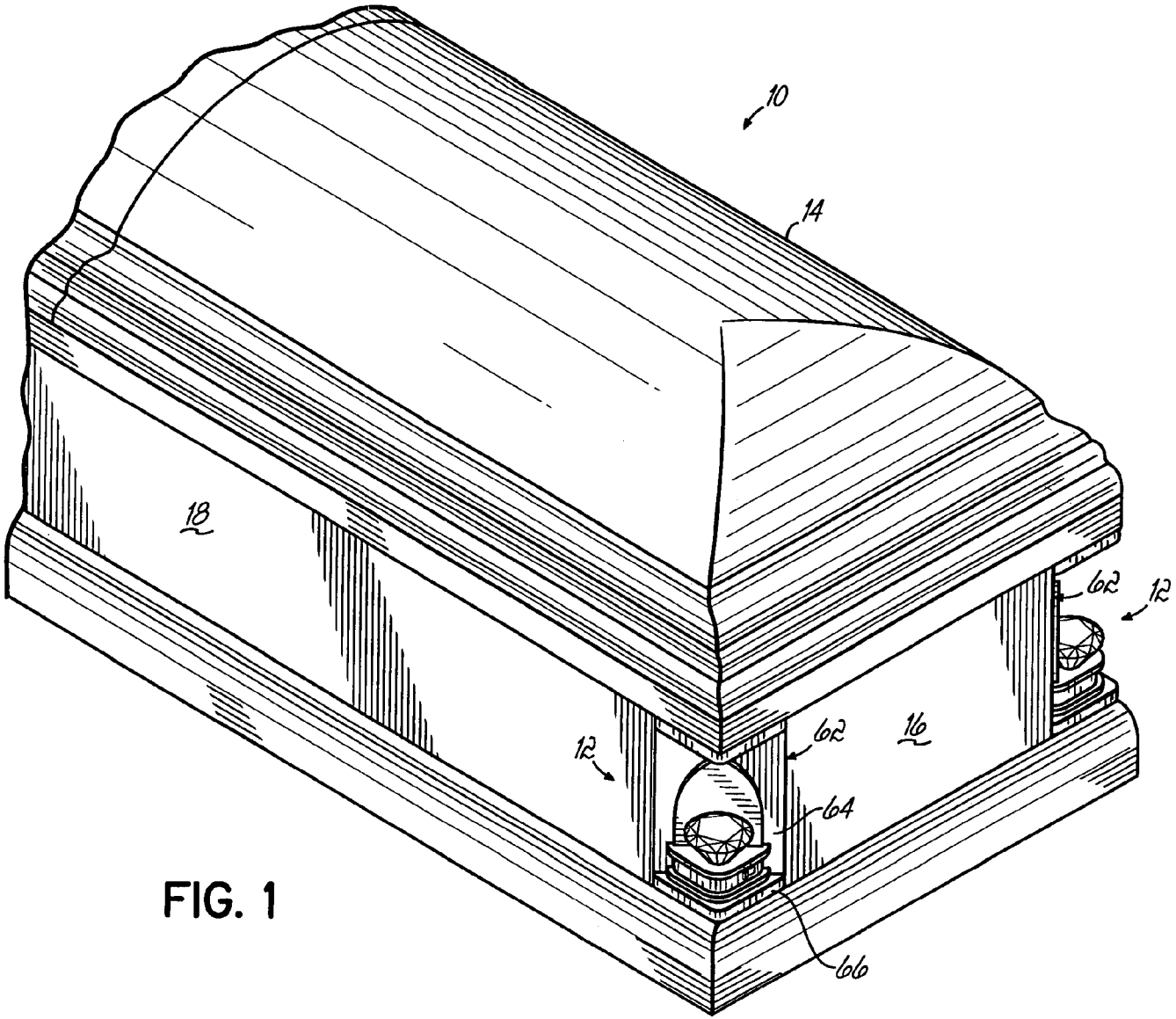
FIG. 1 is a perspective view of a casket embodying the ornamental light assembly of the present invention.

With reference to FIG. 1, a casket 10 is shown incorporating the ornamental light assembly 12 of the present invention. The casket has a cap or lid 14, a pair of oppositely disposed end walls 16 and a pair of oppositely disposed side walls 18. Advantageously, the casket 10 can be made from wood, although the light assembly 12 is not limited to use on wooden caskets, i.e., the light assembly has equal applicability to metal caskets or caskets made of any other suitable material.

Figure 3:
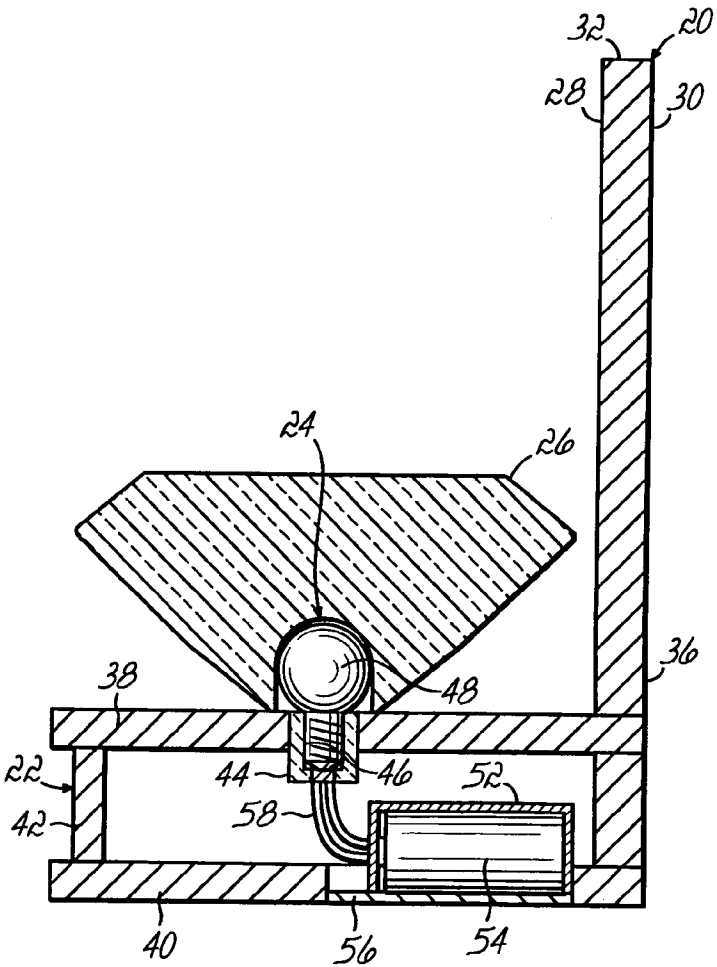
FIG. 3 is a cross sectional view of the ornamental light assembly of FIG. 2 taken generally along line 3—3.
Figure 2:
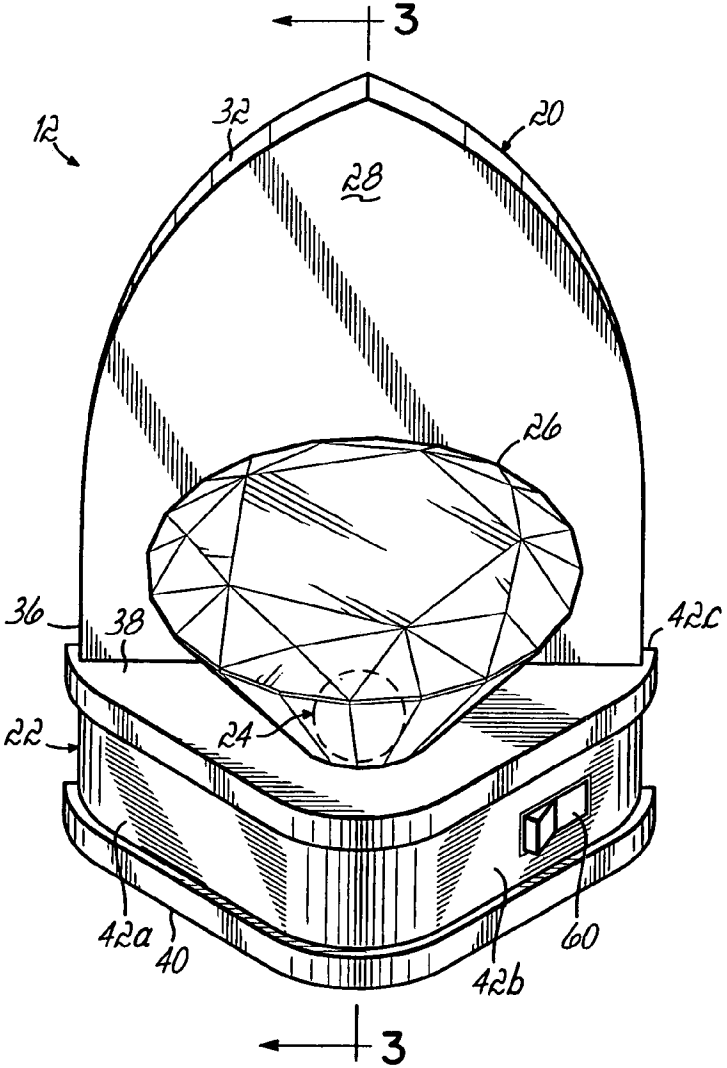
FIG. 2 is a perspective view of an embodiment of an ornamental light assembly of the present invention.
Figure 4:
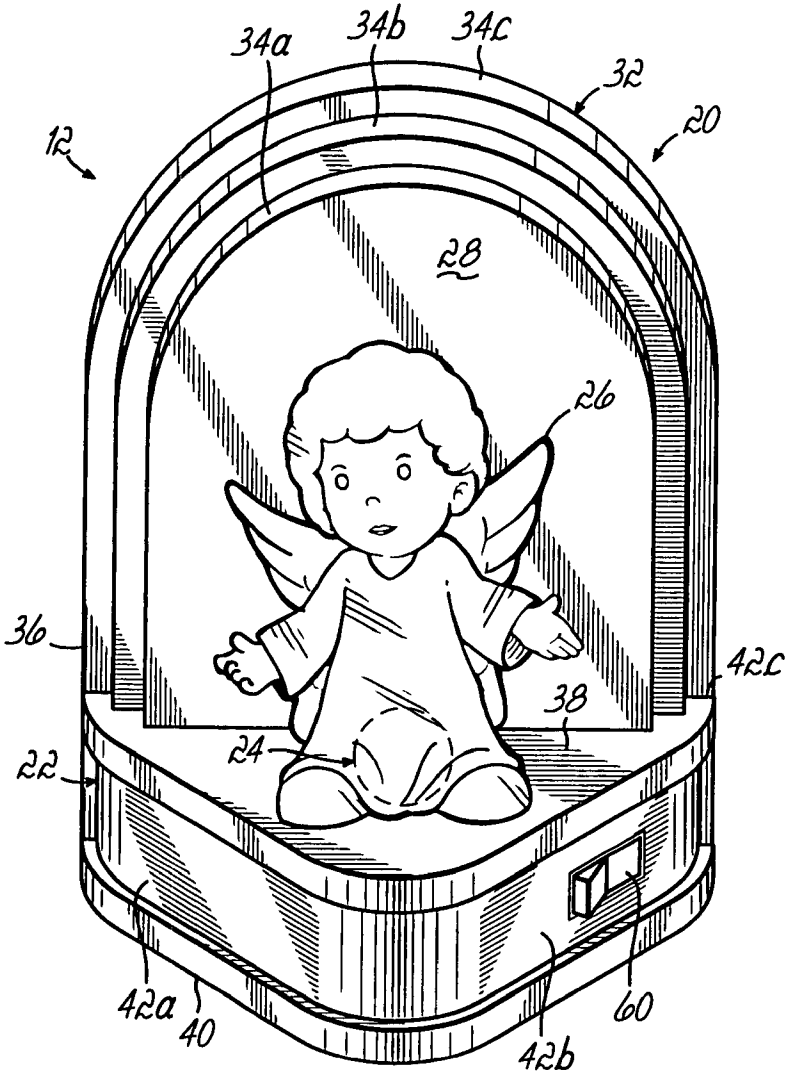
FIG. 4 is a perspective view of another embodiment of an ornamental light assembly of the present invention.

With further reference to FIG. 2 there is shown an embodiment of the ornamental light assembly 12 of the present invention. Ornamental light assembly 12 includes a mounting member, for example a back plate 20 and/or a base member 22, a light source 24 mounted to the mounting member and a translucent ornament 26 overlying or covering the light source 24. Back plate 20 can be generally planar and have a decorative or ornamental side 28 and a mounting side 30. Generally, the decorative side 28 can take a wide variety of aesthetically pleasing shapes having a wide variety of aesthetically pleasing features. For example, and as shown in FIG. 2, the back plate 20 can have a converging or pointed top portion 32. Those having ordinary skill in the art will recognize a wide variety of possible shapes and other decorative features possible with the present invention. For example, FIG. 4 shows another embodiment of an ornamental light assembly, where like reference numerals refer to like features in FIGS. 2–3, having an arcuately shaped top portion 32 and decorative steps 34*a*, 34*b*, 34*c* along the outer edge thereof. The mounting side 30 of back plate 20 is adapted to mount to a casket wall as discussed below. The mounting side 30 is preferably, but not necessarily, flat so that the light assembly 12 can be flushly mounted to a casket wall.

The base member 22 is adapted to couple to a bottom portion 36 of back plate 20. Base member 22 can comprise a top wall 38, a bottom wall 40 and at least one side wall 42 connecting the top and bottom wall 38, 40. As shown in the embodiment in FIG. 2, the base member 22 can be generally triangular with side walls 42*a*, 42*b*, 42*c* and coupling to the back plate 20 along one side 42*c* of the triangularly shaped base member 20. Of course, the base member 22 could be in any other geometric shape other than triangular. The back plate 20 and base member 22 can be made from the same material and can be made to match the material and finish of casket 10. Back plate 20 and base member 22 are preferably wood but could be made from any suitable structural material such as steel, aluminum, plastic or the like. Moreover, back plate 20 and base member 22 can be formed integral with each other during the manufacturing process.

The top wall 38 of base member 22 includes a light source 24 for illuminating at least a portion of casket 10. The light source can, for example, comprise a light socket 44 positioned in the base member 22 and having an opening 46 in top wall 38 for inserting a light bulb 48. To increase the aesthetic value of the light assembly 12 as well as to provide a means to personalize the casket 10, a translucent ornament 26 can overlie light source 24 so that the light emitted from light source 24 is transmitted through the translucent ornament 26. This gives the pleasing appearance that translucent ornament 26 is glowing as a way to provide decorative lighting to the casket shell. Translucent ornament 26 can be removably secured to base member 22 by known means such as double-sided tape or an adhesive. Ornament 26 could just as well be integral with the light source 26 thereby providing a one-piece unit. And, light source 24 could includes one or more LED's or other types of light generating devices.

Translucent ornament 26 can be a decorative design, such as the diamond design shown in FIG. 2, or can be a religious design, such as an angel or the like as shown in FIG. 4. It is contemplated that a funeral director will have a wide variety of translucent ornaments from which a customer can choose so that an ornament can be chosen that has a specific meaning to the deceased or his/her family. In this way, the casket 10 can be personalized to the deceased and provide a more meaningful burial service.

Light assembly 12 can be self contained by further including a power source compartment 52 in base member 22 containing at least one battery 54 for providing power to light source 24, such as light bulb 48. Compartment 52 comprises a door 56 along bottom wall 40 of base member 22 for gaining access to compartment 52 and inserting or changing battery 54. Electrical wires 58 connect battery 54 to light source 24, such as light socket 44 so that when light bulb 48 is inserted into light socket 44, light bulb 48 is illuminated. An electrical switch 60 can further be included in base member 22 and coupled to wires 58 by known means so as to selectively energize light source 24. Power sources other than batteries (i.e. dc power sources) can also be used such as an ac power source, solar power, etc.

Light assembly 12 is adapted to couple to at least one wall of casket 10 along back plate 20 by means known to those having skill in the art. As shown in FIG. 1, although light assembly 12 can be mounted to casket walls 16, 18, light assembly 12 is preferably mounted to a corner 62 disposed between one of the side walls 18 and an adjacent end wall 16. Moreover, each corner 62 between a side wall 18 and an end wall 16 can include a generally vertical corner wall 64 and a generally horizontal corner floor 66. Light assembly 12 can be mounted to corner wall 64 and/or corner floor 66. The corner wall 64 can comprise a traditional corner back plate used in conjunction with former ornamental corner inserts. Alternatively, corner wall 64 can comprise the corner back plate of the quick change ornament attachment mechanism disclosed in Anton et al.

By way of example, back plate 20 can include a threaded insert (not shown) in mounting side 30 and a threaded rod (not shown) engaged with threaded insert and protruding from mounting side 30. Furthermore, corner wall 64 can include a hole therethrough (not shown) aligned with a corresponding hole (not shown) in a casket brace member (not shown). Lighting assembly 12 can be positioned such that back plate 20 is adjacent corner wall 64 with the threaded rod inserted through the hole in corner wall 64 and the hole in the casket brace member. A wing nut (not shown) then threadingly engages the threaded rod to secure the lighting assembly 12 to casket 10.

Again by way of example, light assembly 12 can be adapted to mount to a corner wall 64 comprising the quick change ornament attachment mechanism disclosed in Anton et al. Thus the corner wall 64 can include two keyhole grooves (not shown) having an opening and a slot. Back plate 20 can further include two shoulder screws (not shown) having a head sized to fit through the opening and adapted to be held by the slot. In this way, lighting assembly 12 can be positioned such that back plate 20 is adjacent corner wall 64 with the heads of the shoulder screws inserted through the openings in the keyhole grooves and then moved so as to engage the slots in the keyhole grooves to secure the light assembly 12 to casket 10. Those skilled in the art will recognize other means for securing the light assembly 12 to casket 10. For instance, light assembly 12 does not require back plate 20. In that case, light assembly 12 can be located upon floor 66 and be attached thereto.

Those skilled in the art will readily recognize numerous adaptations and modifications which can be made to the present invention which will result in an improved casket having light assemblies, yet all of which will fall within the spirit and scope of the present invention as defined in the following claims. For example, a light source(s) could be placed on/attached to other external portions of a casket other than the corners of the casket shell, such as the casket lid, the casket handles, the casket handle mounting hardware, etc. And, multiple light sources could be wired together such that a single switch activates all of the light sources. Accordingly, the invention is to be limited only by the scope of the following claims and their equivalents.

What is claimed is:

1. A casket comprising:

a shell including a pair of opposed side walls, a pair of opposed end walls and at least one corner wall disposed between one of said side walls and an adjacent one of said end walls;

a back plate mounted to said corner wall of said shell;

a base member having a top and bottom wall and at least one side wall connecting said top and bottom wall, said base member coupled to said back plate;

a light source coupled to said top wall of said base member; and a translucent ornament overlying said light source so that the light emitted from said light source is transmitted through said translucent ornament.

2. The casket of claim 1 further comprising at least one battery carried in said base member to provide power to said light source.

3. The casket of claim 1 further comprising an electrical switch in said base member for energizing said light source.

4. The casket of claim 1 wherein said light source comprises a light bulb.

5. The casket of claim 1 wherein said base member is generally triangularly shaped, said base member coupling to said back plate along at least a portion of one side of said generally triangularly shaped base member.

6. The casket of claim 1 wherein said back plate and said base member are formed integral with each other.

7. A casket comprising:

a casket shell including a pair of side walls and a pair of end walls, said casket shell adapted to receive and contain therein a deceased; and, a light assembly mounted to at least one of the walls of said casket shell, said light assembly including a light source for illuminating at least a portion of said casket shell.

8. A casket comprising:

a casket shell including a pair of side walls and a pair of end walls; and, a light assembly mounted to at least one of the walls of said casket shell, said light assembly including a light source for illuminating at least a portion of said casket shell;

wherein said light assembly comprises:

a back plate mounted to at least one of the walls of said casket shell;

a base member coupled to said back plate;

said light source coupled to a surface of said base member; and, a translucent ornament overlying said light source so that the light emitted from said light source is transmitted through said translucent ornament.

9. The casket of claim 8 further comprising at least one battery to provide power to said light source.

10. The casket of claim 8 further comprising an electrical switch for energizing said light source.

11. A casket comprising:

a casket shell having a pair of side walls, a pair of end walls and a respective corner formed by adjacent ones of said side and end walls, said casket shell adapted to receive and contain therein a deceased; and, a light assembly including a light source mounted to said corner of said shell for illumination of at least a portion of said shell.

12. A casket comprising:

a casket shell having at least one corner; and, a light assembly mounted to said cornet of said shell;

wherein said light assembly comprises:

a back plate mounted to said corner of said shell;

a base member coupled to said back plate;

a light source coupled to a surface of said base member; and, a translucent ornament overlying said light source so that the light emitted from said light source is transmitted through said translucent ornament.

13. The casket of claim 12 further comprising at least one battery to provide power to said light source.

14. The casket of claim 12 further comprising an electrical switch for energizing said light source.

15. A casket comprising:

a casket shell adapted to receive and contain therein a deceased;

a casket lid closeable upon said casket shell;

said shell and lid having external surfaces defining an exterior of said casket; and a light source mounted to said casket exterior for illuminating at least a portion of said casket exterior.

16. The casket of claim 15 further comprising at least one battery to provide power to said light source.

17. The casket of claim 15 further comprising an electrical switch for energizing said light source.

18. A casket comprising:

a casket shell;

a casket lid closeable upon said casket shell;

said shell and lid having external surfaces defining an exterior of said casket; and a light source mounted to said casket exterior;

further comprising:

a mounting member;

said light source mounted to said mounting member; and, a translucent ornament overlying said light source so that the light emitted from said light source is transmitted through said translucent ornament.

* * * * *